US011193402B2

(12) United States Patent
Ritter et al.

(10) Patent No.: US 11,193,402 B2
(45) Date of Patent: Dec. 7, 2021

(54) VALVE SEAT RING OF A GAS EXCHANGE VALVE AND GAS EXCHANGE VALVE

(71) Applicant: MAN Energy Solutions SE, Augsburg (DE)

(72) Inventors: Bernhard Ritter, Kutzenhausen (DE); Georg Litzel, Dinkelscherben (DE)

(73) Assignee: MAN Energy Solutions SE, Augsburg (DE)

( * ) Notice: Subject to any disclaimer, the term of this patent is extended or adjusted under 35 U.S.C. 154(b) by 0 days.

(21) Appl. No.: 17/097,938

(22) Filed: Nov. 13, 2020

(65) Prior Publication Data

US 2021/0148257 A1 May 20, 2021

(30) Foreign Application Priority Data

Nov. 15, 2019 (DE) ..... 10 2019 130 852.6

(51) Int. Cl.
*F01L 3/02* (2006.01)
*F01L 3/12* (2006.01)
*F01L 3/22* (2006.01)

(52) U.S. Cl.
CPC ..... *F01L 3/02* (2013.01); *F01L 3/12* (2013.01); *F01L 3/22* (2013.01)

(58) Field of Classification Search
CPC ..... F01L 3/02; F01L 3/22; F01L 3/12; F01L 3/14; F01L 3/16; F01L 3/18
See application file for complete search history.

(56) References Cited

U.S. PATENT DOCUMENTS

2002/0121259 A1* 9/2002 Mizutani ..... B23K 20/129 123/188.8
2019/0143415 A1* 5/2019 Kohler ..... F01L 3/02 251/368

FOREIGN PATENT DOCUMENTS

DE 10 2004 027 084 12/2005
DE 10 2011 007 140 10/2012
DE 10 2017 102 544 8/2018

* cited by examiner

*Primary Examiner* — Jacob M Amick
(74) *Attorney, Agent, or Firm* — Cozen O'Connor

(57) ABSTRACT

A valve seat ring for a gas exchange valve of a cylinder of an internal combustion engine includes: a one-part or multi-part main body defining a through-flow opening; and a valve seat region arranged on a portion of the main body in the region of the through-flow opening, a surface of the valve seat region forming a valve seat for a valve body of the gas exchange valve. At least into the main body at least one recess is introduced, which is at least partly filled with a solder material.

9 Claims, 4 Drawing Sheets

VALVE SEAT RING OF A GAS EXCHANGE VALVE AND GAS EXCHANGE VALVE

BACKGROUND OF THE INVENTION

1. Field of the Invention

The invention relates to a valve seat ring of a gas exchange valve of an internal combustion engine. The invention, furthermore, relates to a gas exchange valve for an internal combustion engine.

2. Description of the Related Art

Internal combustion engines known from practice comprise gas exchange valves, namely inlet-side gas exchange valves, via which cylinders of the internal combustion engine can be supplied with charge air or a charge-air mixture, and outlet-side exchange valves, via which exhaust gas can be dissipated from the cylinders of the internal combustion engine.

Each gas exchange valve of an internal combustion engine comprises a valve body, with which valve body a valve seat ring interacts. With a closed gas exchange valve, the valve body lies against or sits on a valve seat of the valve seat ring, whereas with open gas exchange valve the valve body does not lie against the valve seat of the valve seat ring but is removed from or raised off the valve seat of the valve seat ring.

From DE 10 2004 027 084 A1 a valve seat ring of a gas exchange valve of an internal combustion engine is known, which is designed as a cooled valve seat ring. There, the valve seat ring comprises a main body that is composed of multiple parts, namely of at least two ring parts connected to one another via a soldering seam. These two ring parts define a coolant passage for cooling the valve seat ring.

From DE 10 2011 007 140 A1 a further valve seat ring of a gas exchange valve of an internal combustion engine is known. The valve seat ring disclosed there comprises a main body which is formed in one part and defines a through-flow opening. A valve seat region which forms a valve seat is connected to the main body, wherein the valve seat ring is produced by hot isostatic pressing. A coolant passage for cooling the valve seat ring can be introduced into the one-part main body.

From DE 10 2017 102 544 A1 a further valve seat ring for a gas exchange valve of an internal combustion engine is known. Here it is proposed that the valve seat ring consists of different materials. Thus, a three-dimensional structure is formed from a first material, wherein hollow spaces of the three-dimensional structure are filled by a second material, wherein the first material compared with the second material has a higher strength and the second material compared with the first material has a higher heat conductivity. A valve seat region, which forms the actual valve seat, is produced from a third material, wherein the third material compared with the first material and compared with the second material has a higher ductility.

There is a need for further improving a valve seat ring, in particular with respect to an improved dissipate of heat and with a view of a reduced wear.

SUMMARY OF THE INVENTION

In view of this need, it is an object of the present invention to create a new type of valve seat ring of a gas exchange valve and a gas exchange valve having such a valve seat ring.

According to a first aspect of the invention, this object is solved through a valve seat ring in which at least one recess is introduced into the main body and preferentially also into the valve seat region, which is partly filled with a solder material. By way of the at least one recess filled with solder material, heat can be effectively dissipated from the valve seat ring, in particular from the valve seat region of the valve seat ring.

Preferentially, the at least one recess filled with the solder material is introduced into the main body and into the valve seat region, which recess preferentially penetrates the valve seat region as far as to the valve seat. In this case, the solder material can only be utilized for the heat dissipation and also as lubricating material in the region of the valve seat, to reduce the wear of the valve seat ring.

Preferentially, an insert body is placed in the respective recess, which is fixed in the recess via the solder material, wherein the insert body serves for the lubrication and/or heat conduction and/or hard facing. By the insert body, which is fixed by the solder material in the respective recess, the wear of the valve seat ring can be further reduced.

According to a second aspect of the invention, the object is solved through a valve seat ring in which the valve seat region is constructed in layers of different metallic material, which form concentric rings on the valve seat. In this manner it is also possible to dissipate heat from the valve seat region and reduce the wear of the valve seat ring.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are obtained from the following description. Exemplary embodiments of the invention are explained in more detail by way of the drawings without being restricted to this.

In the drawings.

DETAILED DESCRIPTION OF THE PRESENTLY PREFERRED EMBODIMENTS

Figure 1:
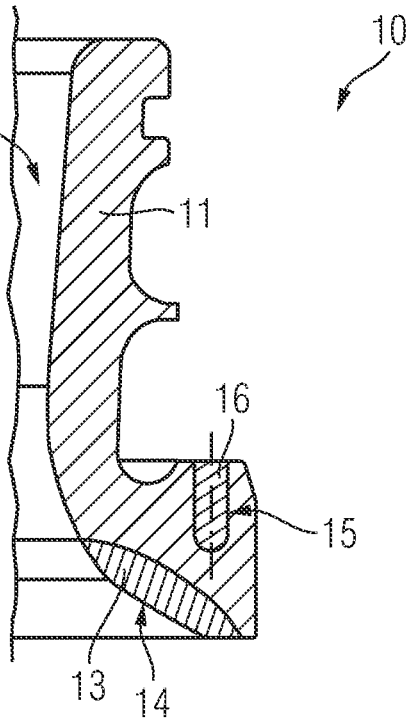
FIG. 1 is an extract of a valve seat ring of a gas exchange valve according to a first aspect of the invention.
Figure 1A:
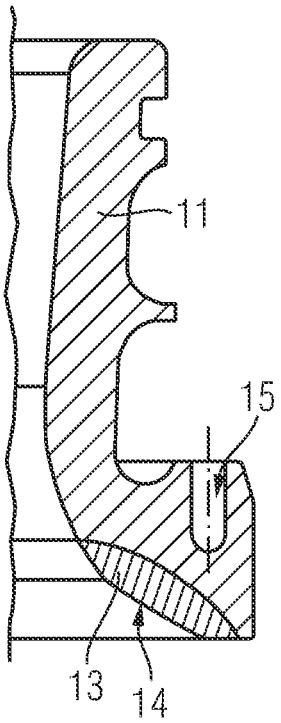
FIGS. 1*a*, 1*b* show intermediate states during the production of the valve seat ring of FIG. 1.
Figure 1B:
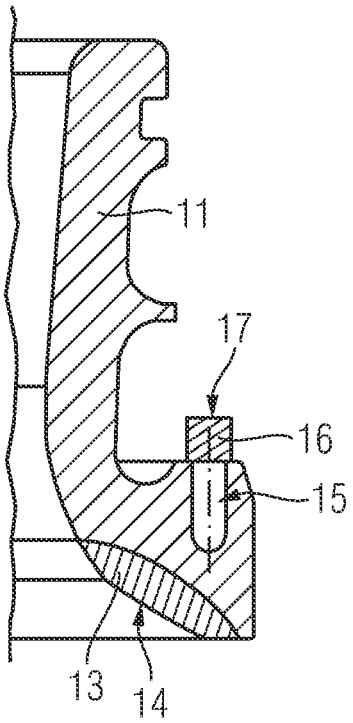

FIGS. 1, 1*a* and 1*b* show details of a first valve seat ring 10 according to a first aspect of the invention. The valve seat ring 10 comprises a main body 11, which defines a through-flow opening 12, wherein in the exemplary embodiment shown in FIGS. 1, 1*a* and 1*b*, the main body 11 is formed in one part.

The valve seat ring 10 comprises a valve seat region 13, which is formed on a portion of the main body 11, wherein a surface of this valve seat region 13 forms a valve seat 14 of the valve seat region 13 and thus of the valve seat ring 10, which during operation interacts with a valve body of a gas exchange valve, which is not shown.

In the exemplary embodiment of FIGS. 1, 1*a* and 1*b*, at least one recess 15 is introduced into the main body 11, which is at least partly, in the exemplary embodiment of FIGS. 1*a*, 1*b* and 1*c*, completely filled with a solder material 16.

In FIGS. 1, 1*a* and 1*b*, this recess 15 is exclusively introduced into the main body 11, namely in such a manner that the recess 15 extends in the axial direction from the main body 11 in the direction of the valve seat region 13 and ends at a distance before the valve seat region 13. The solder material 16, which then serves for heat conduction to dissipate heat from the valve seat ring 11, namely from the valve seat region 13 of the same, is introduced into this recess 15.

FIGS. 1*a* and 1 *b* show intermediate steps for the production of the valve seat ring 10 shown in FIG. 1. Accordingly, FIG. 1*a* shows a state in which the recess 15 is introduced into the main body 11. In FIG. 1*b*, a semi-finished product 17 of the solder material 16 is arranged in a region above the recess 15. By heating this arrangement of FIG. 1*b*, the semi-finished product 17 of the solder material 16 is liquefied and can center the recess 15 for example by vacuum soldering. Following the cooling, the recess 15 is filled with solder material 16.

Figure 2:
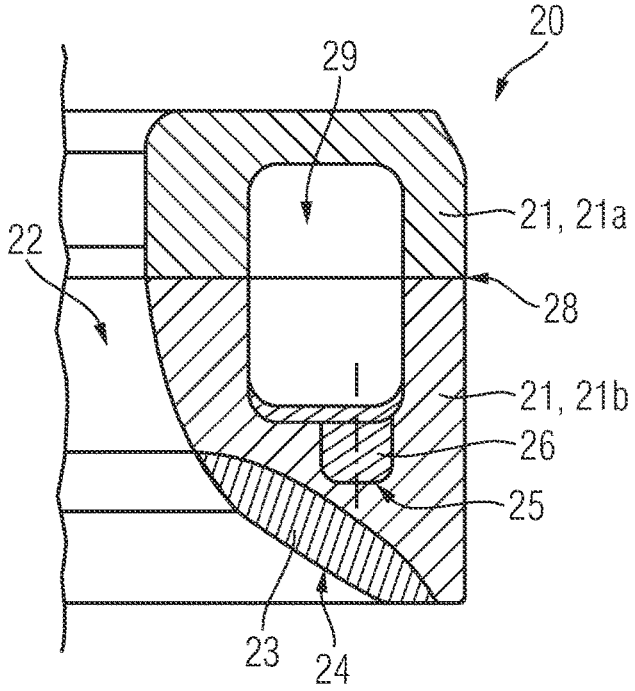
FIG. 2 is an extract from a second valve seat ring of a gas exchange valve according to the first aspect of the invention.
Figure 2A:
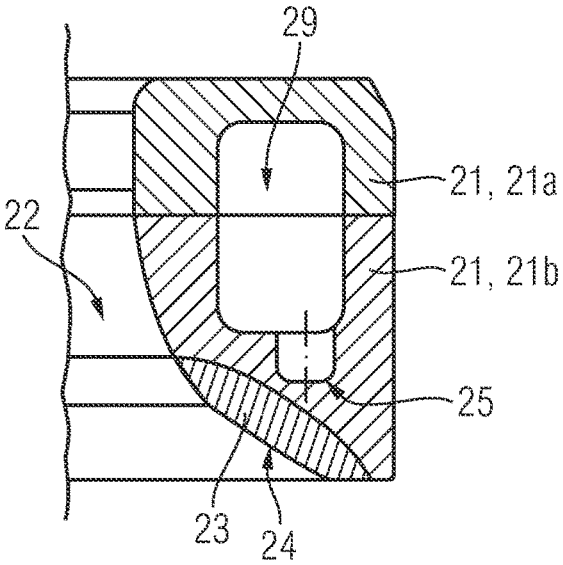
FIGS. 2*a*, 2*b* show intermediate states during the production of the valve seat ring of FIG. 2.
Figure 2B:
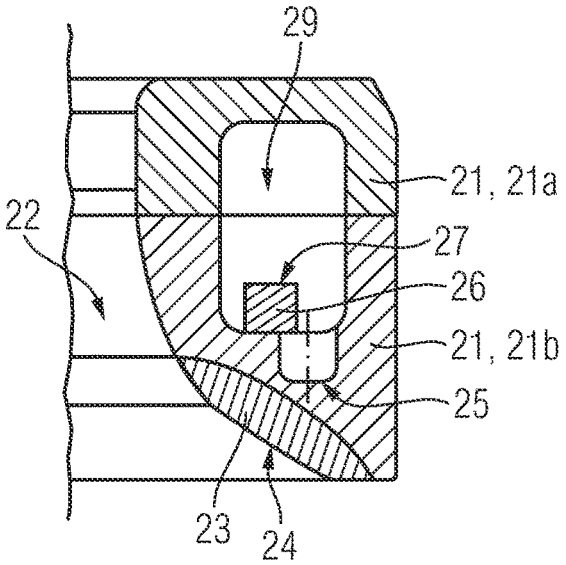

A second exemplary embodiment of a valve seat ring 20 according to the first aspect of the invention is shown by FIG. 2, wherein FIG. 2*a* and FIG. 2*b* in turn show intermediate states of the valve seat ring 20 during the production of the valve seat ring 20.

The valve seat ring 20 of FIG. 2 again comprises a main body 21, which defines a through-flow opening 22, wherein the main body 21 in the exemplary embodiment of FIG. 2 consists, in two parts, of the two parts 21*a*, 21*b*, which are connected to one another along a butt joint 28, in particular by soldering. The two parts 21*a*, 21*b* define a coolant space 26, which during operation is flowed through, for example by water.

On a portion of the main body 21, the valve seat ring 20 comprises a valve seat region 23 whose surface forms the valve seat 24.

At least one recess 25 is introduced into the main body 21, namely into the part 21*b*, which recess is at least partly, in the shown exemplary embodiment, completely filled with the solder material 26, namely according to FIG. 2 such that the solder material 26 also covers a lower portion of the coolant space 29, namely adjoining the respective recess 25.

In FIG. 2, the recess 25 is exclusively introduced into the main body 21, namely such that the recess 25, seen in the axial direction of the through-flow opening 22, extends from the main body 21 in the direction of the valve seat region 23 and ends at a distance before the valve seat region 23.

For producing the valve seat ring 20 of FIG. 2, the procedure according to FIGS. 2*a* and 2*b* is that the recess 25 is introduced into the part 21*b* of the main body 21, subsequently a semi-finished product 27 is of the solder material 26 is placed in the region of the recess 25 and, by heating this arrangement, the semi-finished product 27 is liquefied, so that the solder material 26 can enter the respective recess 25.

Figure 3:
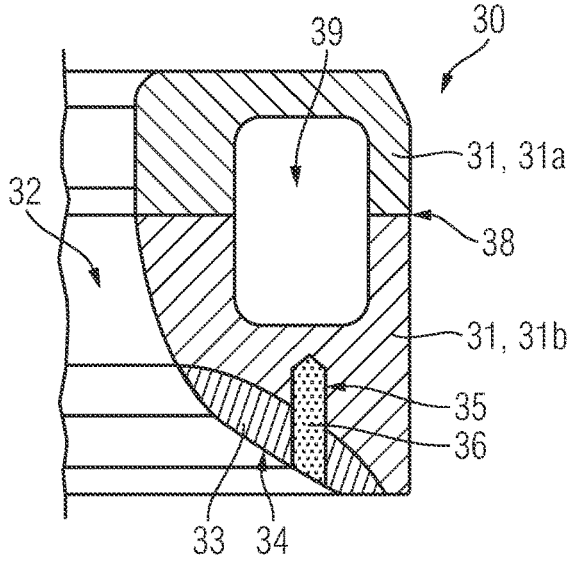
FIG. 3 is an extract from a third valve seat ring of a gas exchange valve according to the first aspect of the invention.

FIG. 3 shows a third exemplary embodiment of a valve seat ring 30 according to the invention as per the first aspect of the invention, whose main body 31 is formed in multiple parts of the parts 31*a* and 31*b*, which are connected to one another along the butt joint 38 analogous to the exemplary embodiment of FIGS. 2, 2*a* and 2*b* and define the coolant space 39.

The main body 31 defines the through-flow opening 32, wherein on a portion of the main body 31 the valve seat region 33 is formed, which forms the valve seat 34. In the exemplary embodiment of FIG. 3, at least one recess 35 filled with solder material 36 is also present, wherein in the exemplary embodiment of FIG. 3 the recess 35 is introduced on the one hand into the valve seat region 33 and on the other hand into the main body 31.

The recess 35 in the exemplary embodiment of FIG. 3 is embodied such that the recess 35 extends in the axial direction of the through-flow opening 32 from the valve seat region 33, which forms the valve seat 34, in the direction of the main body 31 into the main body 31, without however penetrating the main body 31. Into the respective recess 35, solder material 36 is introduced which then serves not only for heat dissipation from the valve seat region 33, but also for the lubrication of the valve seat 34, in order to reduce the wear of the valve seat ring 30 during operation.

Figure 4:
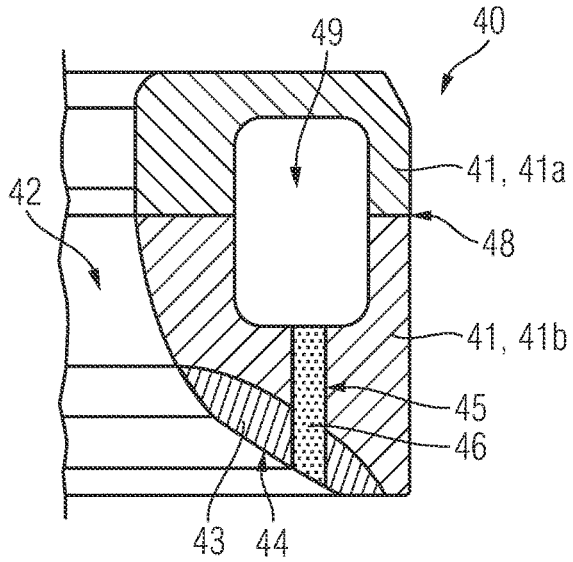
FIG. 4 is an extract from a fourth valve seat ring of a gas exchange valve according to the first aspect of the invention.
Figure 4A:
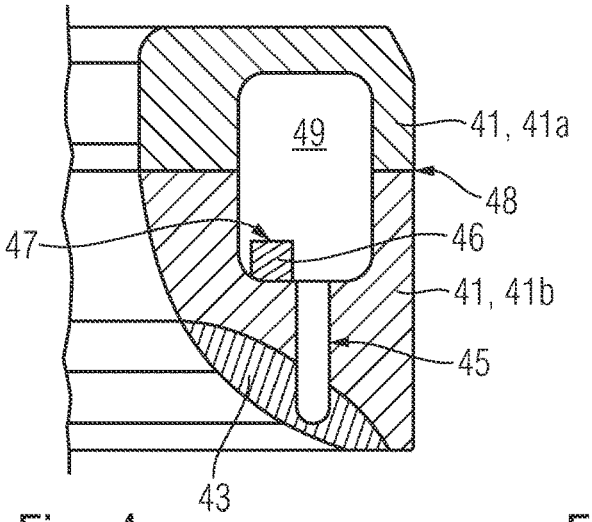
FIGS. 4*a*, 4*b* show intermediate states during the production of the valve seat ring of FIG. 4.
Figure 4B:
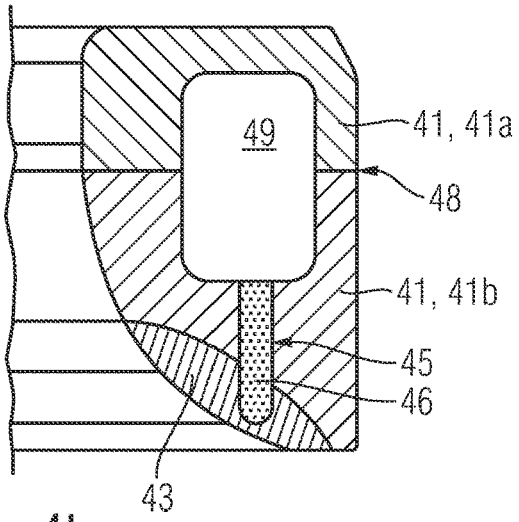

A further exemplary embodiment of a valve seat ring 40 according to the invention as per the first aspect of the invention as well as intermediate states during the production of the same are shown in FIGS. 4, 4*a* and 4*b*. The valve seat ring 40 of FIG. 4 comprises a multi-part main body 41 of the parts 41*a* and 41*b* that are connected in the region of the butt joint 48, which defines a through-flow opening 42, wherein on a portion of the main body 41 the valve seat region 43 is formed, which forms the valve seat 44. At least one recess 45, which is filled with solder material 46, is introduced in FIG. 4 into the main body 41 and into the valve seat region 43, wherein this recess 45, starting out from the main body 41, extends in the direction of the valve seat region 43, namely into the valve seat region 43 and through the same, so that, as in FIG. 3, the solder material 46 can serve for lubrication in the region of the valve seat 44 and additionally for heat dissipation in the direction of the coolant passage 49, wherein however in FIG. 4 the solder material 46 can come into contact with the cooling liquid flowing through the coolant passage 49.

For producing the valve seat ring 40 shown in FIG. 4 the procedure is that a main body 41 with the valve seat region 43 is provided, wherein starting out from the main body 41, namely from the part 41*a* of the same, the recess 45 is introduced into the main body 41 and the valve seat region 43, without completely penetrating the valve seat region 43 initially. Then, a semi-finished product 47 of the solder material 46 is provided and heated, wherein by way of this according to FIG. 4*b* the solder material 46 enters the respective recess 45 filling the same. Following this, the valve seat region 43 is machined by material removal in order to form the valve seat ring 40, at which the solder material 46 in the region of the valve seat 44 is accessible where it can serve for lubrication to reduce wear.

Figure 5:
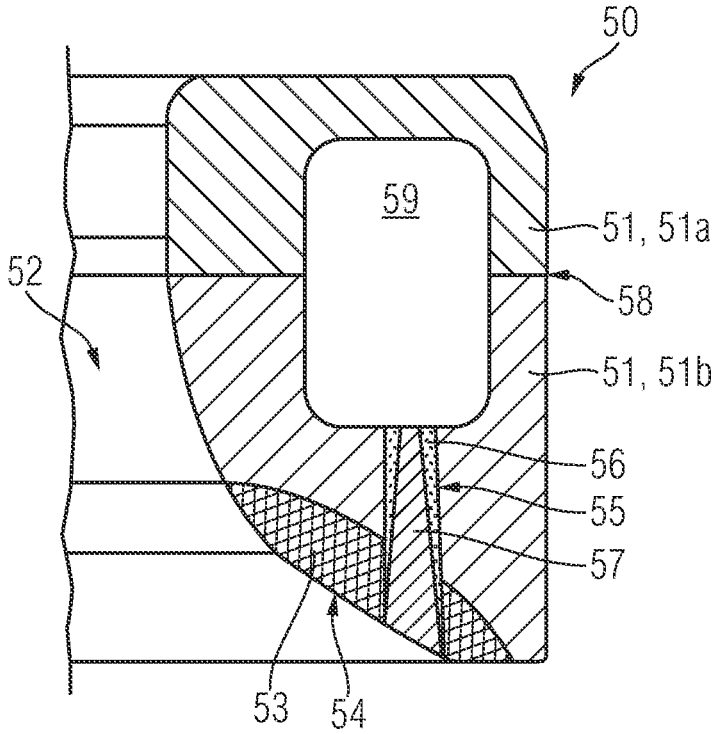
FIG. 5 is an extract from a fifth valve seat ring of a gas exchange valve according to the first aspect of the invention.

FIG. 5 shows an exemplary embodiment of a valve seat ring 50 as per the first aspect of the invention, which comprises a main body 51 of the two parts 51*a* and 51*b* which are connected by soldering in the region of the butt joint 58, which define a coolant space 59. The main body 51 of the valve seat ring 50 of FIG. 5 defines the through-flow opening 52 and comprises a valve seat region 53 which forms the actual valve seat 54.

Analogous to the exemplary embodiment of FIG. 4, at least one recess 55 is introduced into the main body 51 and into the valve seat region 53, which extends through the main body 51, namely the part 51*b*, and the valve seat region 53, wherein however in the exemplary embodiment of FIG. 5, in contrast with the exemplary embodiment of FIG. 4, not only the solder material 56 but additionally an insert body 57 is introduced into the recess 55, which insert body 57 is fixed and accordingly held in the respective recess 55 by the solder material 56. By way of the material of the insert body 57, which is accessible in the region of the valve seat 54, a defined lubrication and/or heat conduction and/or hard facing in the region of the valve seat 54 can be provided in order to reduce the wear susceptibility of the valve seat ring 50.

Figure 6:
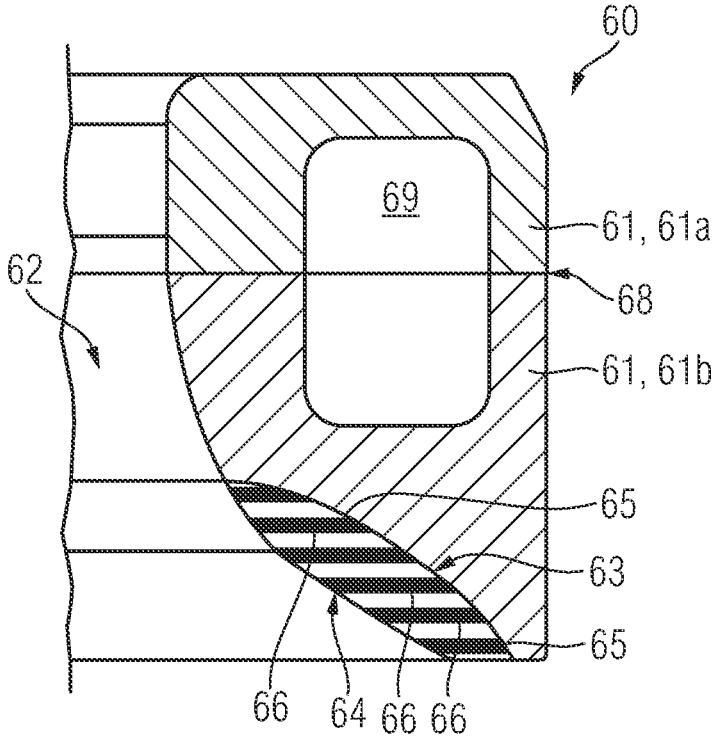
FIG. 6 is an extract from a valve seat ring of a gas exchange valve according to the second aspect of the invention.

An exemplary embodiment of a valve seat ring 60 as per a second aspect of the invention is shown by FIG. 6. The valve seat ring 60 again comprises a main body 61, which consists of the parts 61*a* and 61*b*. The parts 61*a*, 61*b* are connected along the butt joint 68 and define a coolant space 69 for coolant. The main body 61 defines a through-flow opening 62 and comprises a valve seat region 63, whose surface provides the actual valve seat 64.

According to the second aspect of the invention, the valve seat region 63 is constructed in multiple layers 65, 66 of different metallic materials, which form concentric rings on the valve seat ring 64. Thus, the layers 65 are preferentially formed of a highly ductile metallic material and the layers 66 preferentially of a solder material, which serves for the heat conduction and preferentially lubrication. In the region of the rings that are formed by the layers 65, 66, these two metallic materials are each accessible in the region of the valve seat ring 64.

The invention, furthermore, relates to a gas exchange valve having such a valve seat ring and to a valve body which interacts with the valve seat of the respective valve seat ring.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

LIST OF REFERENCE NUMBERS

10 Valve seat ring
11 Main body
12 Through-flow opening
13 Valve seat region
14 Valve seat
15 Recess
16 Solder material
17 Semi-finished product
20 Valve seat ring
21 Main body
21*a*, 21*b* Part
22 Through-flow opening
23 Valve seat region
24 Valve seat
25 Recess
26 Solder material
27 Semi-finished product
28 Butt joint
29 Coolant space
30 Valve seat ring
31 Main body
31*a*, 31*b* Part
32 Through-flow opening
33 Valve seat region
34 Valve seat
35 Recess
36 Solder material
38 Butt joint
39 Coolant space
40 Valve seat ring
41 Main body
41*a*, 41*b* Part
42 Through-flow opening
43 Valve seat region
44 Valve seat
45 Recess
46 Solder material
47 Semi-finished product
48 Butt joint
49 Coolant space
50 Valve seat ring
51 Main body
51*a*, 51*b* Part
52 Through-flow opening
53 Valve seat region
54 Valve seat
55 Recess
56 Solder material
57 Insert body
58 Butt joint
59 Coolant space
60 Valve seat ring
61 Main body
61*a*, 61*b* Part
62 Through-flow opening
63 Valve seat region
64 Valve seat
65 Layer
66 Layer
68 Butt joint
69 Coolant space

What is claimed is:

1. A valve seat ring (10, 20, 30, 40, 50) fora gas exchange valve of a cylinder of an internal combustion engine, comprising:

a one-part or multi-part main body (11, 21, 31, 41, 51) defining a through-flow opening (12, 22, 32, 42, 52); and a valve seat region (13, 23, 33, 43, 53) arranged on a portion of the main body (11, 21, 31, 41, 51) in the region of the through-flow opening (12, 22, 32, 42, 52), wherein a surface of the valve seat region (13, 23, 33, 43, 53) forms a valve seat (14, 24, 34, 44, 54) for a valve body of the gas exchange valve, wherein at least into the main body (11, 21, 31, 41, 51) at least one recess (15, 25, 35, 45, 55) is introduced, which is at least partly filled with a solder material (16, 26, 36, 46, 56), and wherein the at least one recess (15, 25) filled with the solder material (16, 26) is exclusively introduced into the main body (11, 21) such that the recess (15, 25) extends in the axial direction of the through-flow opening (12, 22) from the main body (11, 21) in the direction of the valve seat region (13, 23) and ends at a distance before the valve seat region (13, 23), without extending to the valve seat region (13, 23).

2. The valve seat ring according to claim 1, wherein the solder material (16, 26) conducts heat.

3. A valve seat ring (10, 20, 30, 40, 50) for a gas exchange valve of a cylinder of an internal combustion engine, comprising:

a one-part or multi-part main body (11, 21, 31, 41, 51) defining a through-flow opening (12, 22, 32, 42, 52); and a valve seat region (13, 23, 33, 43, 53) arranged on a portion of the main body (11, 21, 31, 41, 51) in the region of the through-flow opening (12, 22, 32, 42, 52), wherein a surface of the valve seat region (13, 23, 33, 43, 53) forms a valve seat (14, 24, 34, 44, 54) for a valve body of the gas exchange valve, wherein at least into the main body (11, 21, 31, 41, 51) at least one recess (15, 25, 35, 45, 55) is introduced, which is at least partly filled with a solder material (16, 26, 36, 46, 56), wherein the at least one recess (35, 45, 55) filled with the solder material (36, 46, 56) is introduced into the main body (31, 41, 51) and into the valve seat region (33, 43, 53), and wherein the recess (45, 55) extends in the axial direction of the through-flow opening (42, 52) from the main body (41, 52) in the direction of the valve seat region (43, 53) into the valve seat region and penetrates the valve seat region (43, 53) and the valve seat (44, 54).

4. The valve seat ring according to claim 3, wherein the at least one recess (35) extends in the axial direction of the through-flow opening (32) from the valve seat region (33) in the direction of the main body (31) into the main body, without penetrating the main body (31).

5. The valve seat ring according to claim 4, wherein the solder material (36) conducts heat and/or provides lubrication.

6. The valve seat ring according to claim 5, wherein the solder material (46, 56) conducts heat and/or provides lubrication.

7. The valve seat ring according to claim 6, further comprising an insert body (57) arranged in the respective recess (55), the insert body (57) being fixed in the recess (55) by the solder material (56), the insert body (57) providing the lubrication and/or heat induction and/or a hard facing.

8. A valve seat ring (60) for a gas exchange valve of a cylinder of an internal combustion engine, comprising:

a one-part or multi-part main body (61) defining a through-flow opening (62); and a valve seat region (63) formed on a portion of the main body (61) in the region of the through-flow opening (62), wherein a surface of the valve seat region (63) forms a valve seat (64) for a valve body of the gas exchange valve, wherein the valve seat region (63) comprises layers (65, 66) of different metallic material, and form concentric rings on the valve seat (64), and wherein the valve seat region (63) comprises multiple layers (65) of a highly ductile metallic material and multiple layers (66) of a solder material, the solder material conducting heat and/or providing lubrication.

9. A gas exchange valve of an internal combustion engine having a valve body and having the valve seat ring (10, 20, 30, 40, 50, 60) according to claim 1 as the valve body.

* * * * *